US007552741B2

(12) United States Patent
Yamada et al.

(10) Patent No.: US 7,552,741 B2
(45) Date of Patent: Jun. 30, 2009

(54) FLUID CONTROLLING METHOD, MICROFLUIDIC DEVICE AND PROCESS FOR FABRICATING THE SAME

(75) Inventors: Takayuki Yamada, Kanagawa (JP); Kazuaki Tabata, Kanagawa (JP); Yoshihisa Yamazaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 270 days.

(21) Appl. No.: 11/302,134

(22) Filed: Dec. 14, 2005

(65) Prior Publication Data

US 2006/0272722 A1 Dec. 7, 2006

(30) Foreign Application Priority Data

Jun. 7, 2005 (JP) ..... 2005-166456

(51) Int. Cl.
*B07B 4/00* (2006.01)
*B04C 3/00* (2006.01)

(52) U.S. Cl. ..... 137/3; 137/599.03; 137/896; 366/181.5; 366/340

(58) Field of Classification Search ..... 137/896, 137/897, 898, 1, 3, 599.03; 366/337, 338, 366/339, 181.5, 340; 209/722, 723, 725, 209/726; 210/512.1, 512.2
See application file for complete search history.

(56) References Cited

U.S. PATENT DOCUMENTS

| | | | | | |
|---|---|---|---|---|---|
| 1,036,758 | A | * | 8/1912 | Walters et al. | 251/126 |
| 2,784,948 | A | * | 3/1957 | Pahl et al. | 366/181.5 |
| 4,050,676 | A | * | 9/1977 | Morishima et al. | 366/339 |
| 4,065,277 | A | * | 12/1977 | Dahlem | 55/418 |
| 4,109,318 | A | * | 8/1978 | Hutchings | 366/338 |
| 4,265,741 | A | * | 5/1981 | Im | 209/725 |
| 4,407,327 | A | * | 10/1983 | Hanson et al. | 137/625.3 |
| 5,881,756 | A | * | 3/1999 | Abbasi et al. | 137/599.03 |
| 6,217,208 | B1 | | 4/2001 | Schuchardt | 366/147 |

FOREIGN PATENT DOCUMENTS

| | | |
|---|---|---|
| JP | A 2001-276661 | 10/2001 |
| JP | A 2003-210959 | 7/2003 |

OTHER PUBLICATIONS

Seok Woo Lee et al., "Split And Recombination Micromixer Based On PDMS Three-Dimensional Micro Structure", The 13th International Conference on Solid-State Sensors, Actuators and Microsystems, Seoul, Korea, Jun. 5-9, 2005, pp. 1533-1536.

* cited by examiner

*Primary Examiner*—Stephen M Hepperle
(74) *Attorney, Agent, or Firm*—Oliff & Berridge, PLC

(57) ABSTRACT

A fluid controlling method includes, sending an inner fluid, and sending an outer fluid coaxially with the inner fluid, wherein one of the inner fluid and the outer fluid includes a corkscrew flow that flows spirally, and wherein the inner fluid and the outer fluid are in contact with each other.

12 Claims, 9 Drawing Sheets

FLUID CONTROLLING METHOD, MICROFLUIDIC DEVICE AND PROCESS FOR FABRICATING THE SAME

BACKGROUND OF THE INVENTION

1. Field of the Invention

The present invention relates to a fluid controlling method for controlling plural fluids, a microfluidic device using the fluid controlling method, and a process for fabricating the device.

2. Description of the Related Art

Such an attempt has been widely carried out that a micro flow channel is formed, in which two or more kinds of fluids (including liquid and gas) are flowed as being in contact with each other, and various chemical reactions (including synthesis and cleansing) are carried out an interface between them. As an example of the conventional microfluidic device, a micromixer using a coaxial flow channel has been known (as described, for example, in JP-A-2003-210959).

The micromixer has a flow channel in such a manner that one fluid A is coaxially surrounded by the other fluid B. Since the fluids A and B flow as laminar flows, the fluid A flowing at the center is not in contact with a wall of the flow channel, which brings about an advantage that particles contained in the fluid A do not stack on the wall surface.

Since two liquids form laminar flows in the micro flow channel, it is necessary to provide a certain structure for effectively agitating the liquids to promote the reaction between them. As an example of the conventional mixer device having an agitating structure, a device has been known which includes more than two zigzagged bars and mix two liquids by using a segment produced by a metal casting method (as described, for example, in U.S. Pat. No. 6,217,208).

A classifying device utilizing difference in specific weight or ascending force has been known (as described, for example, in JP-A-2001-276661 (paragraph (0004) and FIG. 4)).

In the classifying device, particles are introduced to a classifying area between upper and lower circular disks through an annular introducing slit, and air is made in fall from the outer circumference toward the center of the classifying area, whereby only particles having a particular particle diameter are classified to reach an annular slit provided in the lower disk, and thus the classified particles are taken out from a drawing duct.

SUMMARY OF THE INVENTION

According to the conventional micromixer using a coaxial flow channel, in which two fluids flow as laminar flows in the axial direction, a long flow channel is necessary for obtaining a certain extent of reaction, which brings about such a defect that the device is increased in size. Furthermore, the conventional mixer device has a complex structure for mixing liquids, and thus the production of the device requires a difficult process. The conventional classifying device utilizing gravity or ascending force requires a long flow channel, and the accuracy of classification is not so high due to the use of difference in specific weight or ascending force.

The present invention has been made in view of the circumstances and provides a fluid controlling method and a microfluidic device capable of being reduced in size and classifying with high accuracy.

Also the present invention provides a microfluidic device capable of being produced easily.

According to one aspect of the invention, the present invention may provide a fluid controlling method including, sending an inner fluid, sending an outer fluid coaxially with the inner fluid wherein one of the inner fluid and the outer fluid includes a spiral flow that flows spirally, and wherein the inner fluid and the outer fluid are in contact with each other.

According to another aspect of the invention, the present invention may provide a microfluidic device including, an inner flow channel in which an inner fluid flows, an outer flow channel in which an outer fluid flows, the outer flow channel being formed coaxially with the inner flow, a common flow channel in which the inner fluid and the outer fluid flow in contact with each other, the common flow channel being communicated with the inner flow channel and the outer flow channel, and a rectifier that adds a flow velocity in a circumferential direction to one of the inner fluid and the outer fluid, wherein the rectifier is disposed in one of the inner flow channel and the outer flow channel.

As a still another aspect of the invention, the present invention may provide a process for fabricating the microfluidic device as described above. The process including forming a plurality of thin film patterns each corresponding to cross sectional shape of the microfluidic device, on a first substrate, and repeating bond-and-release of the first substrate having the plurality of the thin film patterns formed thereon and a second substrate to transfer the plurality of the thin film patterns onto the second substrate.

BRIEF DESCRIPTION OF THE DRAWINGS

Preferred embodiments of the present invention will be described in detail based on the following figures, wherein:

FIGS. 1A and 1B show a microfluidic device according to a first embodiment of the invention, in which FIG. 1A is a elevational view thereof, and FIG. 1B is a cross sectional view thereof on line A-A in FIG. 1A;

FIGS. 5A and 5B show a microfluidic device according to a second embodiment of the invention, in which FIG. 5A is a elevational view thereof, and FIG. 5B is a cross sectional view thereof on line B-B in FIG. 5A;

DETAILED DESCRIPTION OF THE INVENTION

Figure 1A:
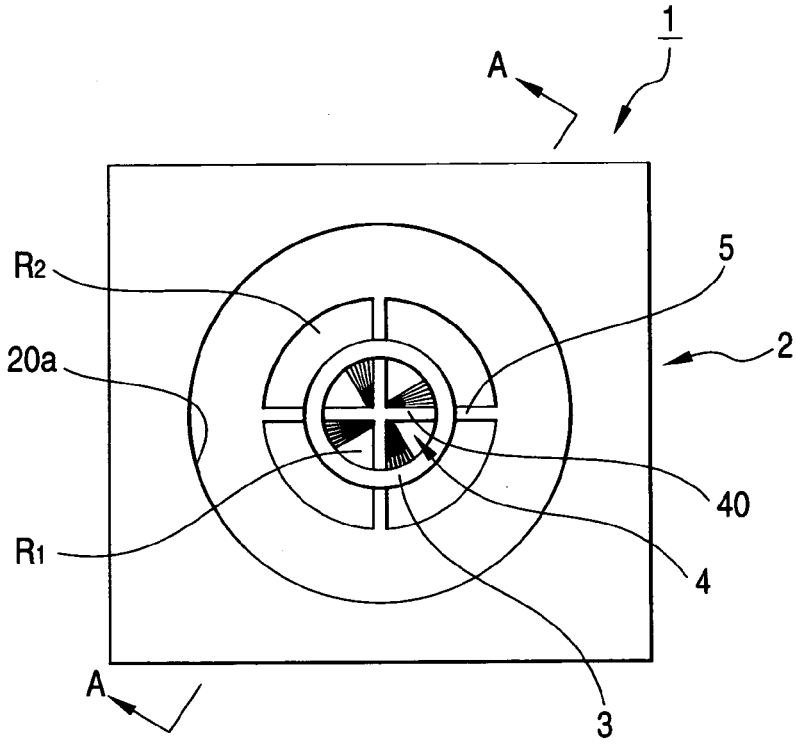
Figure 1B:
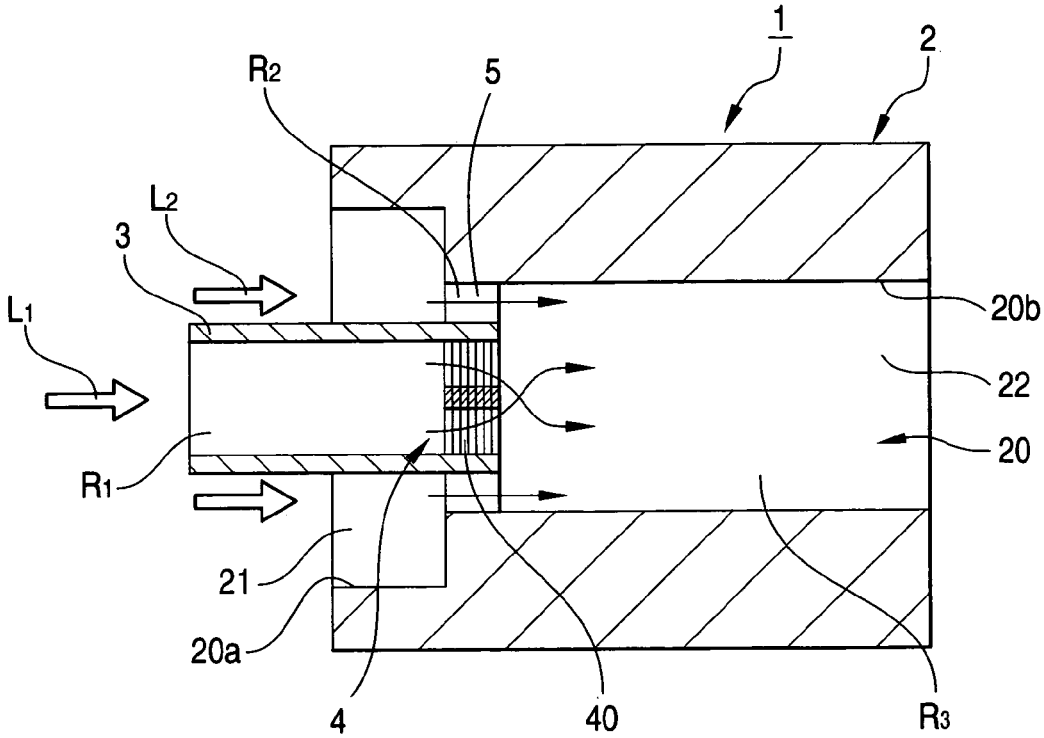

FIGS. 1A and 1B show a microfluidic device according to a first embodiment of the invention, in which FIG. 1A is an elevational view thereof, and FIG. 1B is a cross sectional view thereof on line A-A in FIG. 1A. The microfluidic device 1 has a device main body 2 in a substantially box shape having a through hole 20, and an inner pipe 3 disposed coaxially with the through hole 20 of the device main body 2.

The inner pipe 3 has inside the tube an inner flow channel $R_1$, in which an inner fluid $L_1$ flows, has at an back end inside the tube a rectifier 4 imparting a flow velocity in a circumferential direction to the inner fluid $L_1$ to rectify the fluid to a spiral flow, and is mounted on the through hole 20 of the device main body with a mounting member 5.

The rectifier 4 has plural rectifying plates 40 having a cross form, and as shown in FIG. 1A, the rectifying plates 40 are connected to the inner wall of the inner pipe 3 in such a manner that the connecting parts of the rectifying plates 40 are deviated in the rotation direction little by little with the progress of the inner fluid $L_1$.

The through hole 20 of the device main body 2 contains a large diameter part 20*a* forming an-outer inlet port 21 for introducing an outer fluid $L_2$ with the inner tube 3, and a short diameter part 20*b* having an inner diameter that is smaller than the large diameter part 20*a* but is larger than the inner pipe 3. An outer flow channel $R_2$ is formed to extend from the outer inlet port 21 to a gap between the small diameter part 20*b* and the inner tube 3, and a common flow channel $R_3$ is formed at the downstream side thereof, in which the inner fluid $L_1$ and the outer fluid $L_2$ are in contact with each other. The most downstream side of the small diameter part 20*b* forms an outlet port 22 for the fluids $L_1$ and $L_2$.

Production Process of First Embodiment

Figure 2:
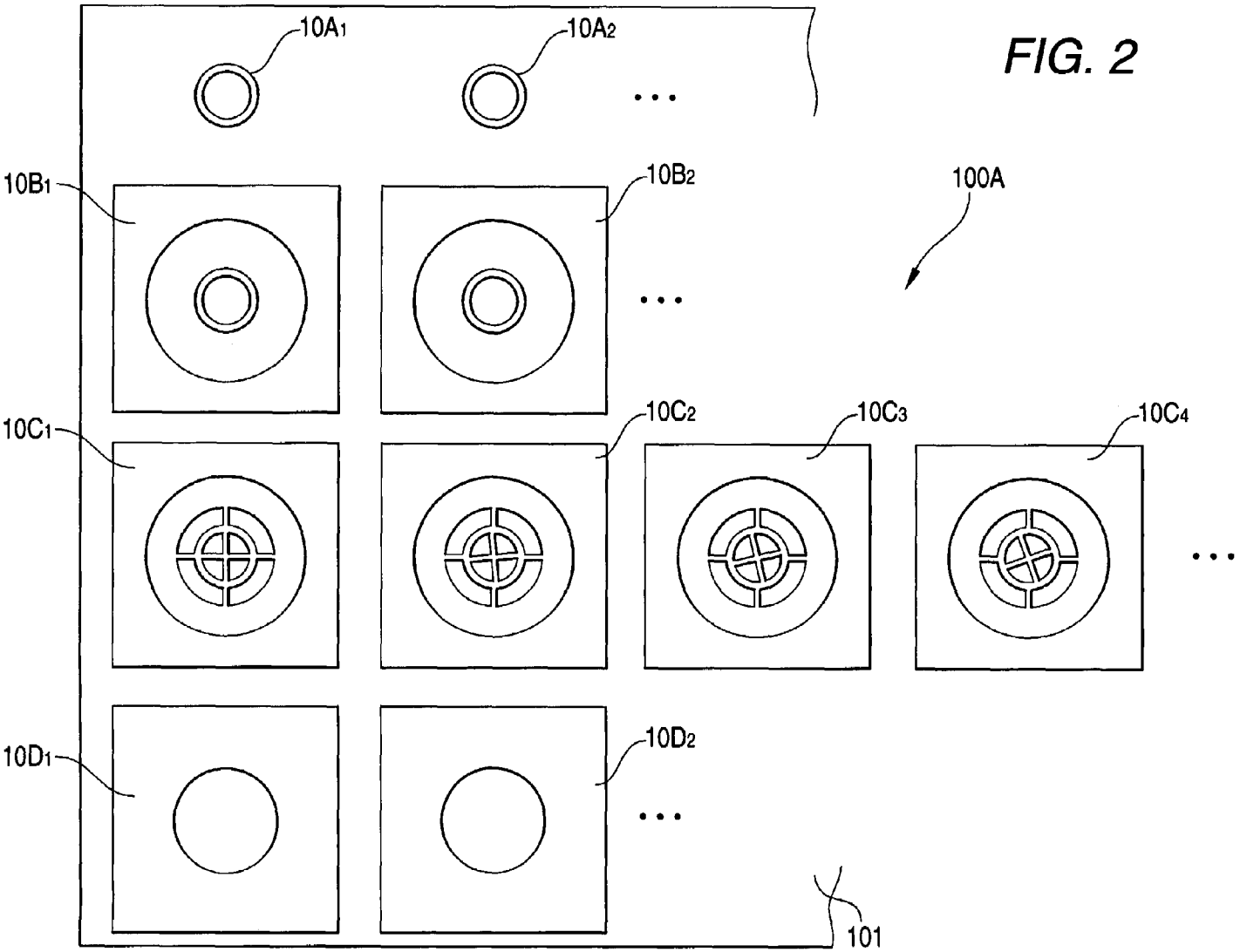
FIG. 2 is a diagram showing a donor substrate according to the first embodiment.

A production process of the microfluidic device 1 according to the first embodiment of the invention will be described with reference to FIG. 2 and FIGS. 3A to 3F. FIG. 2 shows a donor substrate, and FIGS. 3A to 3F show an accumulating step.

(1) Production of Donor Substrate

A donor substrate is produced herein by an electroforming method. A metallic substrate 101 formed, for example, with stainless steel having a prescribed surface roughness is prepared, and a thick photoresist is coated on the metallic substrate 101. The photoresist is exposed with a photomask corresponding to the cross sectional shapes of the microfluidic device 1 to be produced, and then the photoresist is developed to form resist patterns, which is an inverted patterns of the cross sectional shapes. The metallic substrate 101 having the resist patterns is dipped in a plating bath to grow nickel plating on the surface of the metallic substrate 101 that is not covered with the photoresist.

The resist pattern is then removed to form thin film patterns 10$A_1$, 10$A_2$, . . . 10$B_1$, 10$B_2$, . . . 10$C_1$, 10$C_2$, 10$C_3$, 10$C_4$, . . . 10$D_1$, 10$D_2$ . . . (which are hereinafter referred to as a thin film patterns 10) corresponding to the cross sectional shapes of the microfluidic device 1 on the surface of the metallic substrate 110. The metallic substrate 101 having the thin film patterns 10 is hereinafter referred to as a donor substrate 100A.

The thin film patterns 10$A_1$, 10$A_2$, . . . correspond to a part of the inner pipe 3 that protrude from the device main body 2, the thin film patterns 10$B_1$, 10$B_2$, . . . correspond to a part thereof positioned at the large diameter part 20*a*, the thin film patterns 10$C_1$, 10$C_2$, 10$C_3$, 10$C_4$, . . . correspond to a part thereof positioned at the rectifier 4, and the thin film patterns 10$D_1$, 10$D_2$, . . . correspond to apart thereof positioned at the common flow channel $R_3$.

(2) Accumulation of Thin Film Patterns

Figure 3A:
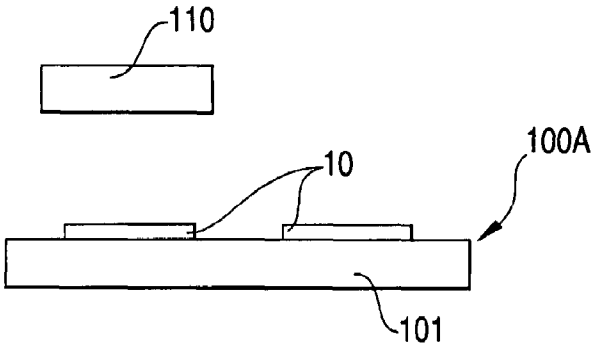
FIGS. 3A to 3F are diagrams showing production steps of the first embodiment.

As shown in FIG. 3A, the donor substrate 100A is placed on a lower stage, which is not shown in the figure, in a vacuum chamber, and a target substrate 110 is placed on an upper stage, which is not shown in the figure, in the vacuum chamber. Subsequently, the vacuum chamber is evacuated to form a high vacuum state or a superhigh vacuum state. The lower stage is moved with respect to the upper stage to dispose the thin film patter 10 for the first layer immediately beneath the target substrate 110. The surface of the target substrate 110 and the surface of the thin film patter 10 for the first layer are cleaned by irradiating with an argon atomic beam.

Figure 3B:
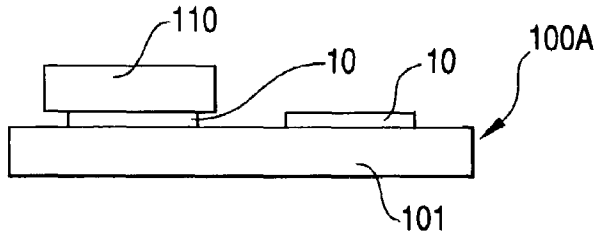

As shown in FIG. 3B, the upper stage is brought down, and the target substrate 110 and the donor substrate 100A are pressed to each other at a prescribed load (for example 10 kgf/cm$^2$) for a prescribed period of time (for example, 5 minutes) to bond the target substrate 110 and the thin film patter 10 for the first layer at a room-temperature. The order of accumulation of the thin film patterns 10 is preferably a descending order in cross sectional area of the patterns. In this embodiment, it is preferred that the thin film patterns 10D, 10C, 10B and 10A are accumulated in this order.

Figure 3C:
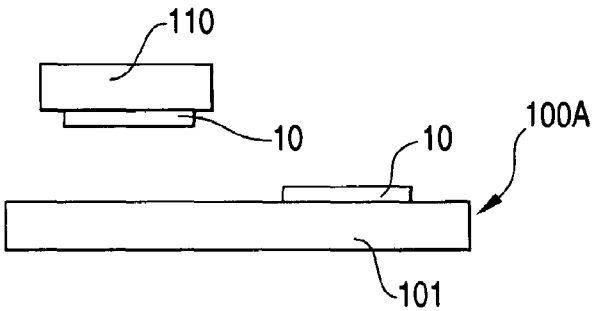

As shown in FIG. 3C, upon bring up the upper stage, the thin film pattern 10 for the first layer is released from the metallic substrate 101 and transferred onto the target substrate 110. This is because the adhesion force between the thin film pattern 10 and the target substrate 110 is larger than the adhesion force between the thin film pattern 10 and the metallic substrate 101.

Figure 3D:
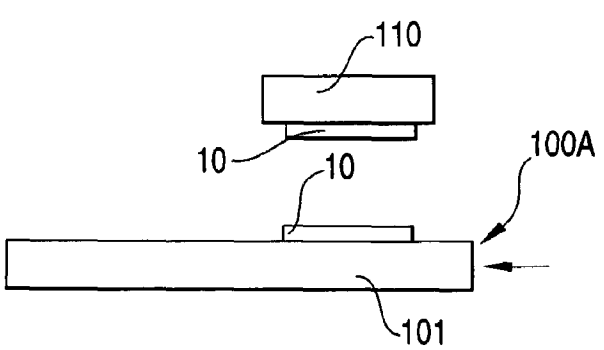

As shown in FIG. 3D, the lower stage is moved to dispose the thin film patter 10 for the second layer immediately beneath the target substrate 110. The surface of the thin film pattern 10 thus transferred to the target substrate 110 (i.e., the surface thereof that had been in contact with the metallic substrate 101) and the surface of the thin film patter 10 for the second layer are cleaned in the same manner as above.

Figure 3E:
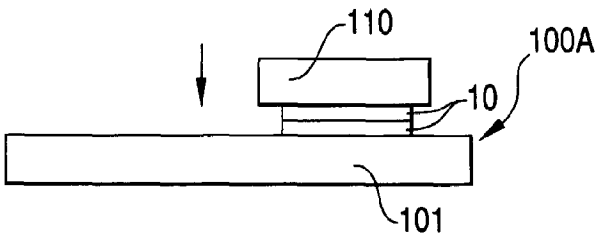
Figure 3F:
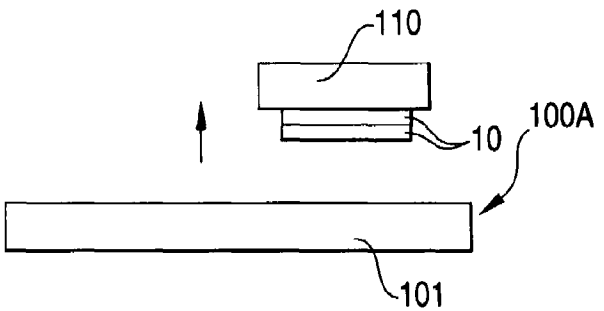

As shown in FIG. 3E, the upper stage is brought down to bond the thin film patterns for the first and second layers, and as shown in FIG. 3F, upon bring up the upper stage, the thin film pattern 10 for the second layer is released from the metallic substrate 101 and transferred onto the target substrate 110.

The other thin film patterns 10 are subjected to repeated positioning of the donor substrate 100A and the target substrate 110, bonding and releasing in the same manner as above, whereby the plural thin film patterns 10 corresponding to the cross sectional shapes of the microfluidic device 1 are transferred onto the target substrate 110. The accumulated body thus transferred to the target substrate 110 is released from the upper stage, from which the target substrate 110 is removed, to obtain the microfluidic device 1 shown in FIG. 1.

(Classification Operation of Particles)

Figure 4:
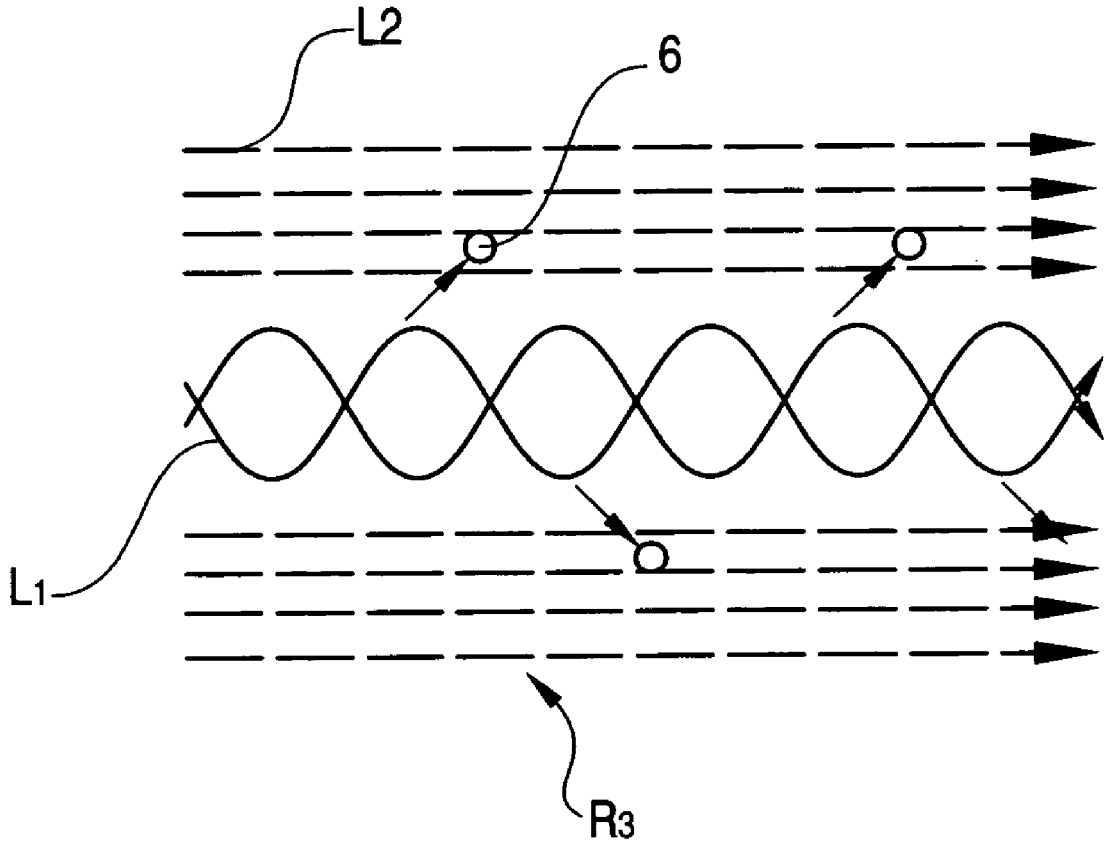
FIG. 4 is a diagram showing flows of an inner fluid and an outer fluid in the first embodiment.

FIG. 4 is a diagram showing flows of an inner fluid and an outer fluid. The inner fluid $L_1$ containing particles 6 is introduced into the inner pipe 3 at a prescribed flow rate, and the outer fluid $L_2$ is introduced into the outer inlet port 21 at a prescribed flow rate. The inner fluid $L_1$ forms a spiral flow with the rectifier 4 and proceeds in the common flow channel $R_3$ to be in contact with the outer fluid $L_2$. While the inner fluid $L_1$ proceeds in the common flow channel $R_3$, the particles 6 that do not meet standard in weight, size or the like migrate to the outer fluid $L_2$ owing to centrifugal force, difference in flowing direction between the fluids $L_1$ and $L_2$, difference in flow rate between them, or the like, and the inner fluid $L_1$ and the outer fluid $L_2$ are discharged from the outlet port 22. The inner fluid $L_1$ thus discharged from the outlet port 22 contains only the particles that meet the standard. Thus, the particles 6 have been classified. The flow rate of the outer fluid $L_2$ may be larger than that of the inner fluid $L_1$, whereby the migration of the particles 6 that do not meet the standard from the inner fluid $L_1$ to the outer fluid $L_2$ can be accelerated.

Advantage of the First Embodiment

According to the first embodiment, particles are classified in weight, diameter or the like by centrifugal separation or rotational separation, in which the inner fluid $L_1$ flowing inside forms a spiral flow, and the inner fluid $L_1$ is in contact with the outer fluid $L_2$ flowing outside coaxially with the inner fluid $L_1$, whereby classification with high accuracy can be attained with a short flow channel. The microfluidic device 1 can be obtained only by accumulating the thin film patterns 10, whereby the microfluidic device 1 can be easily produced.

Second Embodiment

Figure 5A:
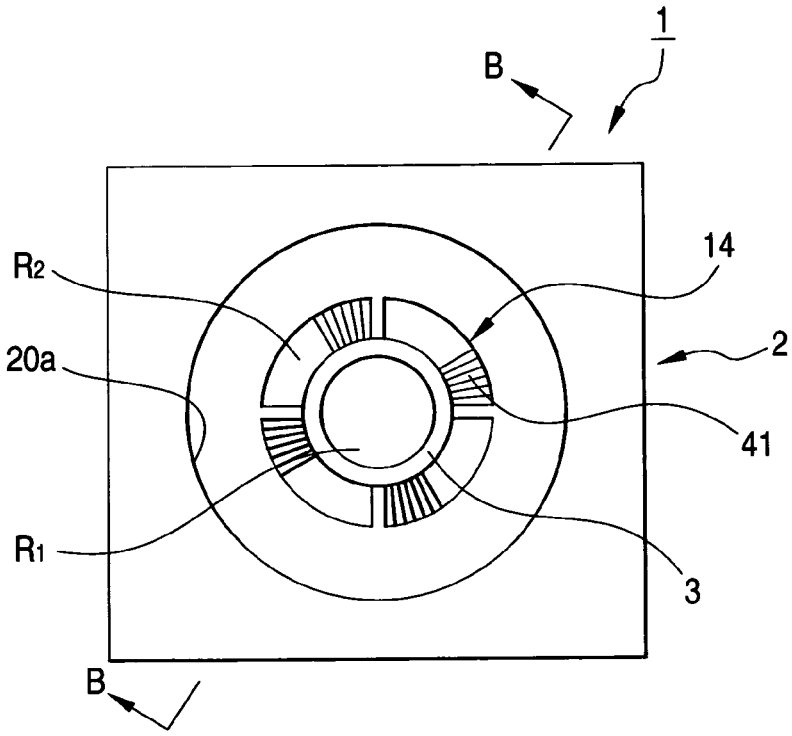
Figure 5B:
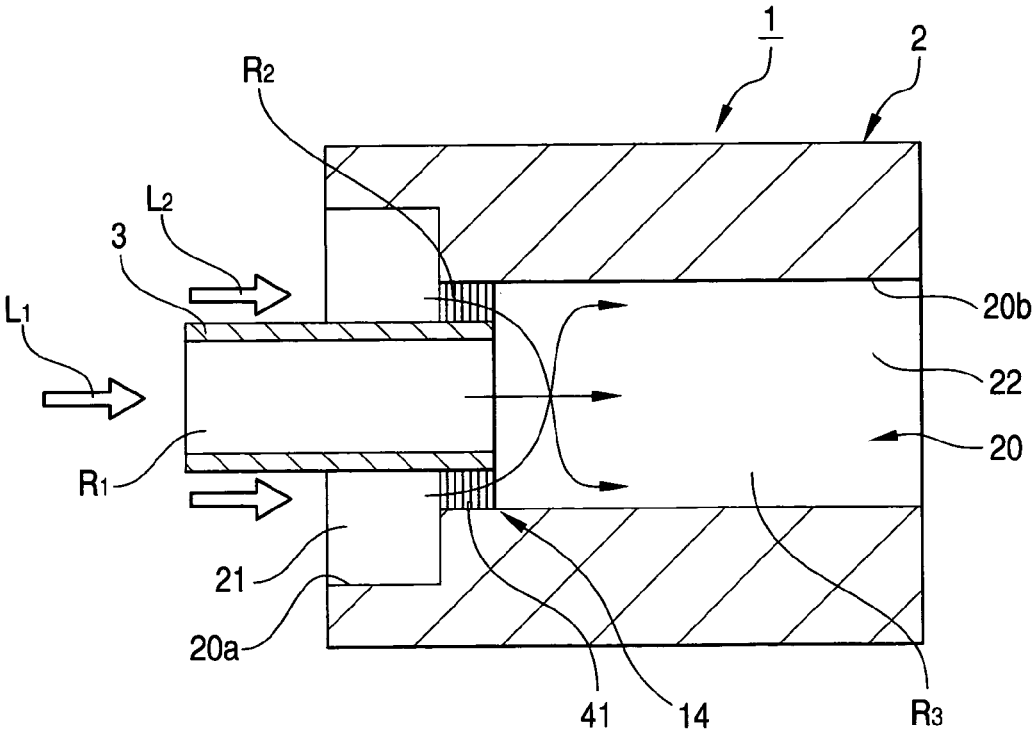

FIGS. 5A and 5B show a microfluidic device according to a second embodiment of the invention, in which FIG. 5A is an elevational view thereof, and FIG. 5B is a cross sectional view thereof on line B-B in FIG. 5A. The second embodiment has the same constitution as the first embodiment except that a rectifier 14 is disposed between the inner pipe 3 and the small diameter part 20*b* of the device main body 2.

The rectifier 14 contains plural rectifying plates 41 in a strip form extending radially from the inner pipe 3 and being connected to the small diameter part 20*b*, and as shown in FIG. 5A, the connecting parts of the rectifying plates 41 to the small diameter part 20*b* are deviated in the rotation direction little by little with the progress of the inner fluid $L_2$.

Production Process of Second Embodiment

Figure 6:
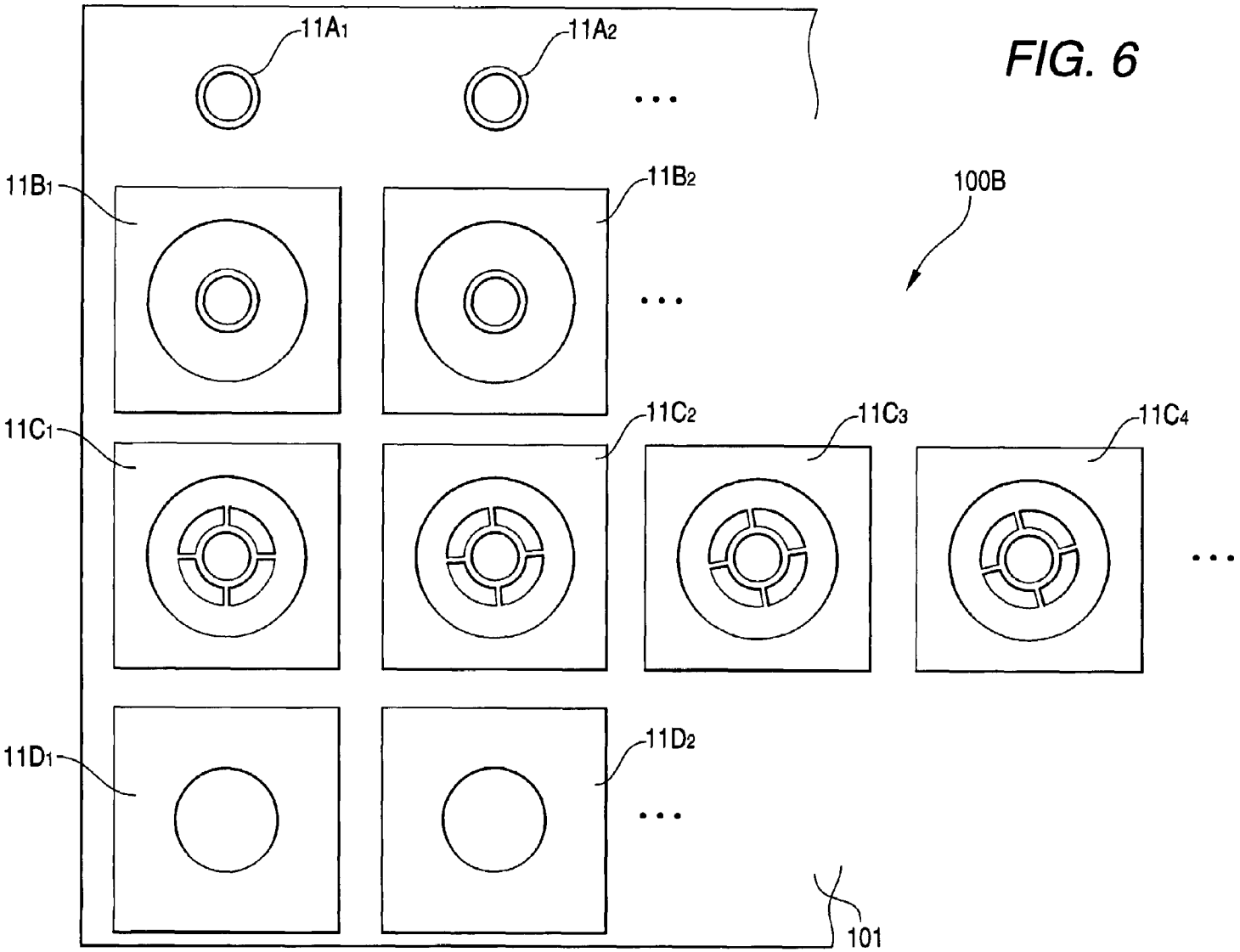
FIG. 6 is a diagram showing a donor substrate according to the second embodiment.

A production process of the microfluidic device 1 according to the second embodiment of the invention will be described with reference to FIG. 6. FIG. 6 shows a donor substrate.

(1) Production of Donor Substrate

As shown in FIG. 6, thin film patterns 11$A_1$, 11$A_2$, . . . 11$B_1$, 11$B_2$, . . . 11$C_1$, 11$C_2$, 11$C_3$, 11$C_4$, . . . 11$D_1$, 11$D_2$ . . . (which are hereinafter referred to as a thin film patterns 11) corresponding to the cross sectional shapes of the microfluidic device 1 are formed on a surface of a metallic substrate 101 by an electroforming method in the same manner as in the first embodiment. The metallic substrate 101 having the thin film patterns 11 is hereinafter referred to as a donor substrate 100B.

The thin film patterns 11$A_1$, 11$A_2$, . . . correspond to a part of the inner pipe 3 that protrude from the device main body 2, the thin film patterns 11$B_1$, 11$B_2$, . . . correspond to a part thereof positioned at the large diameter part 20*a*, the thin film patterns 11$C_1$, 11$C_2$, 11$C_3$, 11$C_4$, . . . correspond to a part thereof positioned at the rectifier 14, and the thin film patterns 11$D_1$, 11$D_2$, . . . correspond to a part thereof positioned at the common flow channel $R_3$.

(2) Accumulation of Thin Film Patterns

The donor substrate 100B is placed in a vacuum chamber, and a target substrate and the donor substrate 100B are subjected to repeated positioning, bonding and releasing in the same manner as described in the first embodiment. Accordingly, the thin film patterns 11 shown in FIG. 6 are released from the metallic substrate 101 and transferred onto the target substrate, whereby the plural thin film patterns 11 corresponding to the cross sectional shapes of the microfluidic device 1 are transferred onto the target substrate. The accumulated body thus transferred to the target substrate is released from the upper stage, from which the target substrate is removed, to obtain the microfluidic device 1 shown in FIG. 5.

(Classification Operation of Particles)

Figure 7:
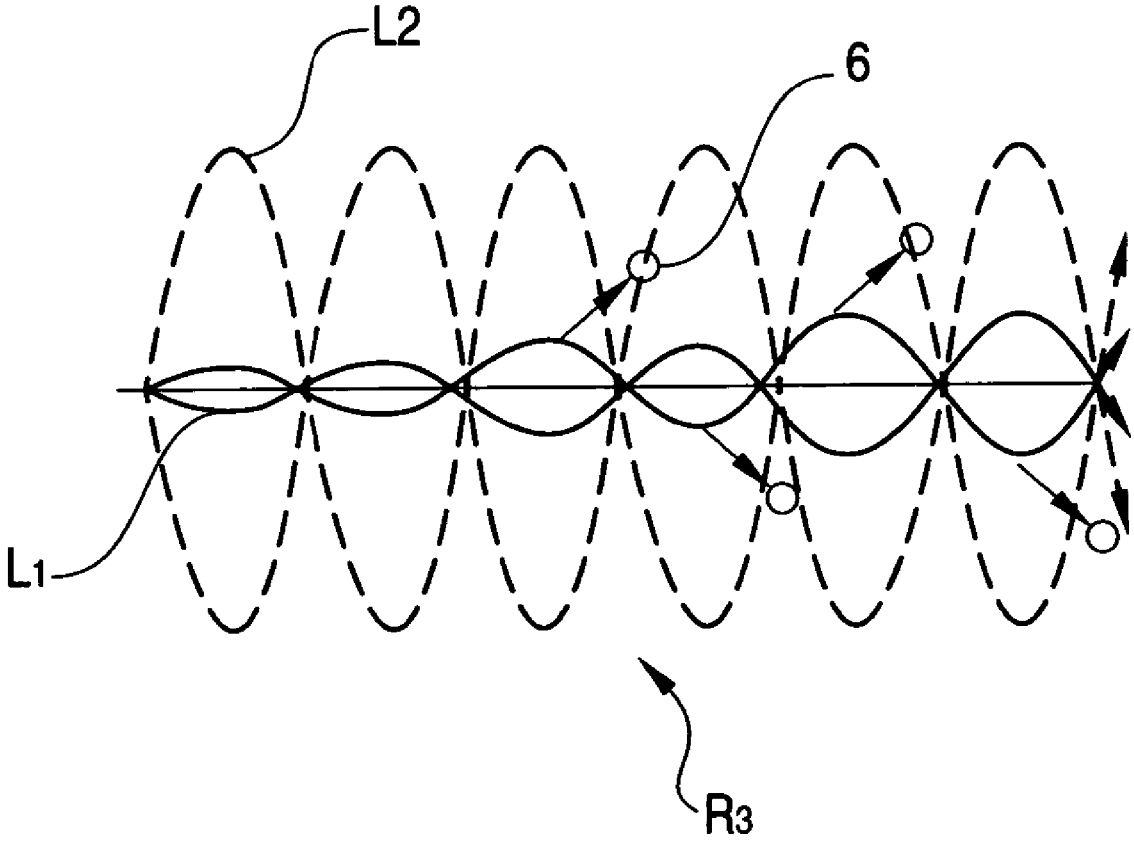
FIG. 7 is a diagram showing flows of an inner fluid and an outer fluid in the second embodiment.

FIG. 7 is a diagram showing flows of an inner fluid and an outer fluid. The inner fluid $L_1$ containing particles 6 is introduced into the inner pipe 3 at a prescribed flow rate, and the outer fluid $L_2$ is introduced into the outer inlet port 21 at a prescribed flow rate. The outer fluid $L_2$ forms a spiral flow with the rectifier 14 and proceeds in the common flow channel $R_3$ to be in contact with the inner fluid $L_1$. The inner fluid $L_1$ is dragged by the spiral flow of the outer fluid $L_2$ and also forms a spiral flow. While the inner fluid $L_1$ proceeds in the common flow channel $R_3$, the particles 6 that do not meet standard in weight, size or the like migrate to the outer fluid $L_2$ owing to centrifugal force, difference in flowing direction between the fluids $L_1$ and $L_2$, difference in flow rate between them, or the like, and the inner fluid $L_1$ and the outer fluid $L_2$ are discharged from the outlet port 22. The inner fluid $L_1$ thus discharged from the outlet port 22 contains only the particles that meet the standard. Thus, the particles 6 have been classified. The flow rate of the outer fluid $L_2$ may be larger than that of the inner fluid $L_1$, whereby the migration of the particles 6 that do not meet the standard from the inner fluid $L_1$ to the outer fluid $L_2$ can be accelerated.

Advantage of the Second Embodiment

According to the second embodiment, particles are classified in such a manner that the outer fluid $L_2$ flowing outside forms a spiral flow, and the outer fluid $L_2$ is in contact with the inner fluid $L_1$ flowing inside coaxially with the outer fluid $L_2$, whereby classification with high accuracy can be attained with a short flow channel. The microfluidic device 1 can be obtained only by accumulating the thin film patterns 11, whereby the microfluidic device 1 can be easily produced.

Third Embodiment

Figure 8:
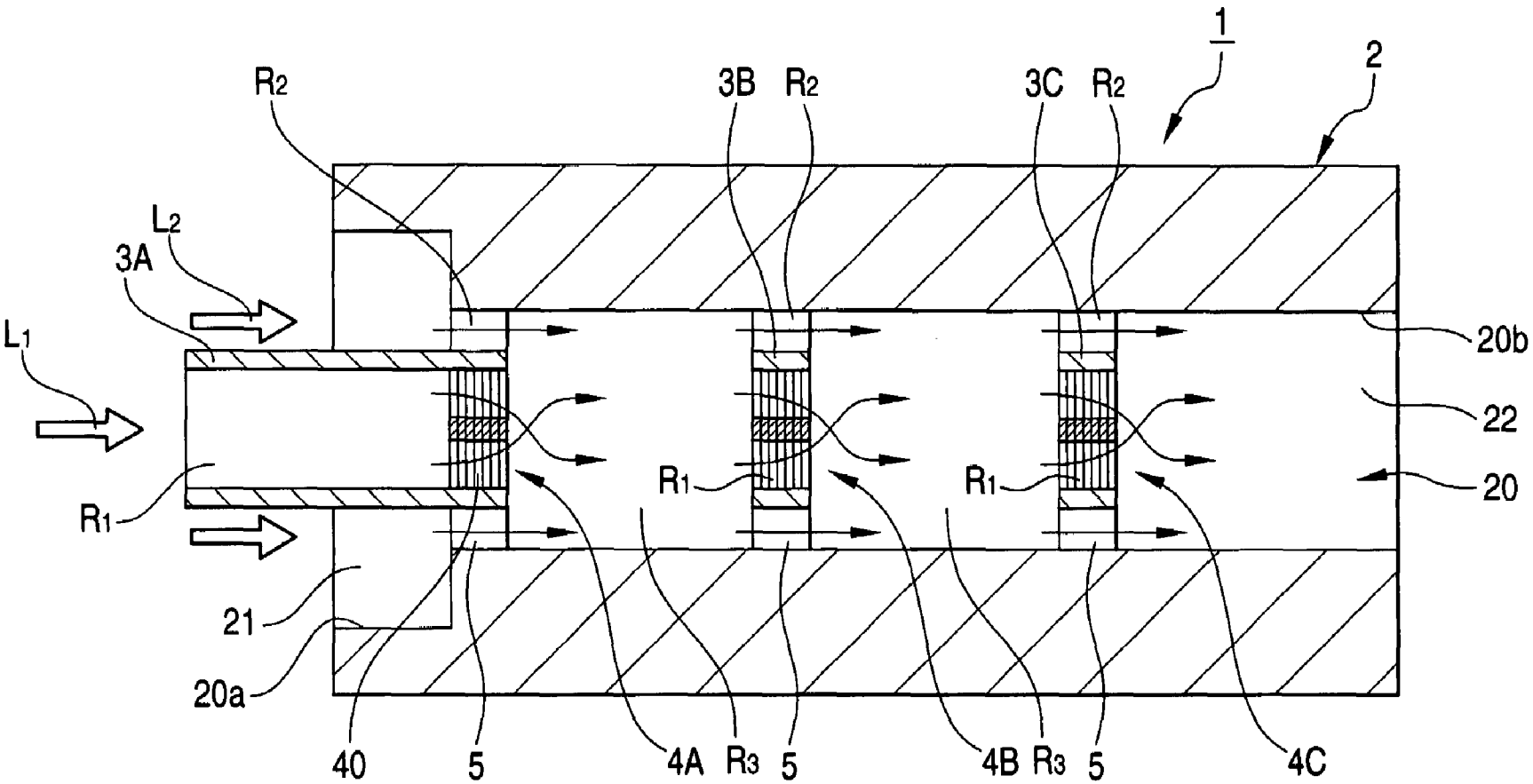
FIG. 8 is a cross sectional view showing a microfluidic device according to a third embodiment of the invention.

FIG. 8 is a cross sectional view showing a microfluidic device according to a third embodiment of the invention. The third embodiment has the same constitution as the first embodiment except that plural rectifiers 4 are provided in series.

The first rectifier 4A is disposed inside an inner pipe 3A having the same structure as the first embodiment, and the second and third rectifiers 4B and 4C are disposed inside inner pipes 3B and 3C having the same lengths as the lengths of the rectifiers 4B and 4C, respectively. The inner pipes 3B and 3C are mounted on the small diameter part 20*b* of the device main body 2 with mounting members 5 as similar to the inner pipe 3A.

According to the third embodiment, the spiral flow of the inner fluid $L_1$ is gradually attenuated by friction with the wall surface of the inner pipe 3 and contact with the outer fluid $L_2$ upon proceeding inside the inner pipes 3A, 3B and 3C and inside the common flow channels R3 among between the rectifiers 4A, 4B and 4C, but the spiral flow of the inner fluid $L_1$ can be retained by disposing the plural rectifiers 4A to 4C in series.

Fourth Embodiment

Figure 9:
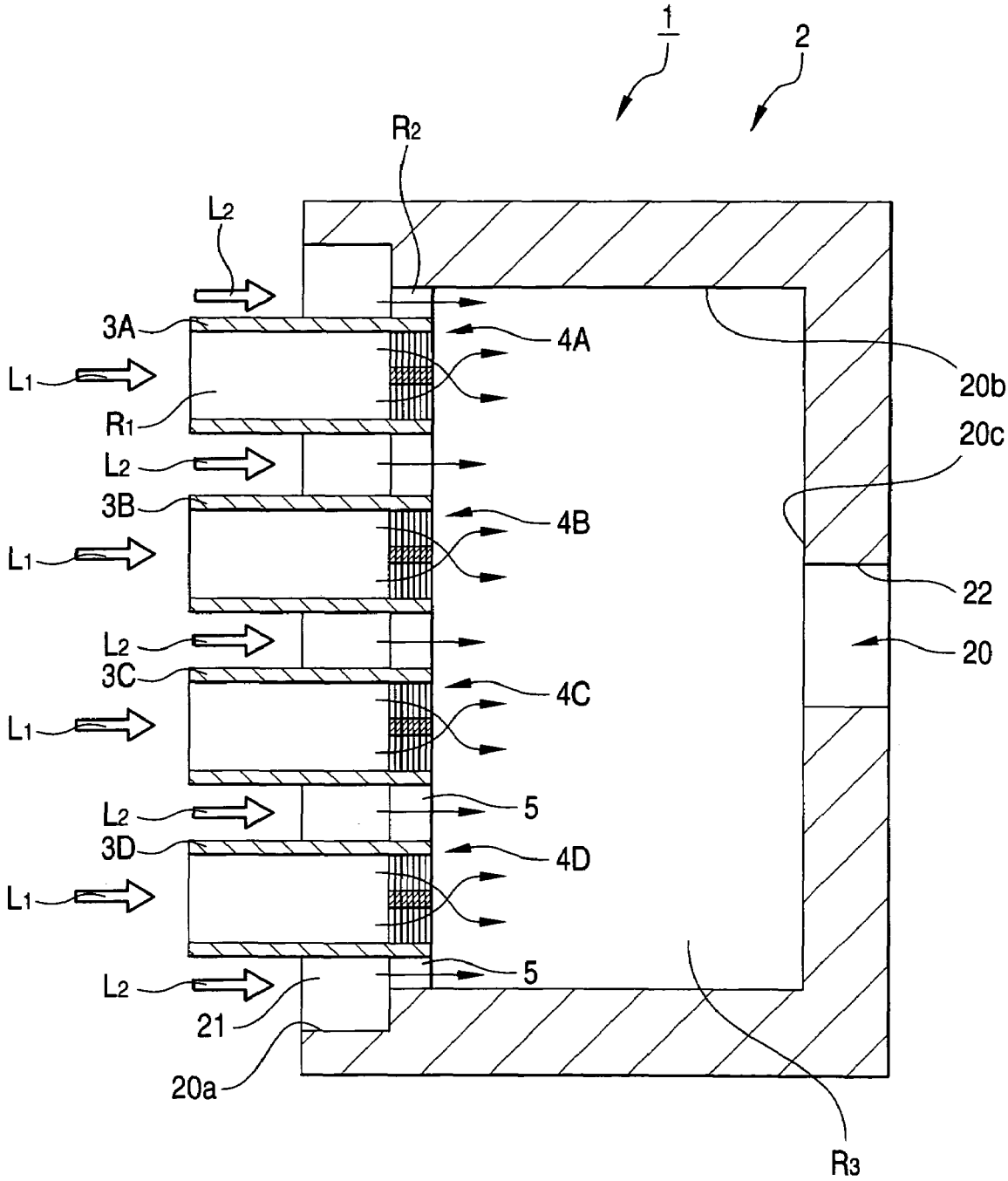
FIG. 9 is a cross sectional view showing a microfluidic device according to a fourth embodiment of the invention.

FIG. 9 is a cross sectional view showing a microfluidic device according to a fourth embodiment of the invention.

The fourth embodiment has the same constitution as the first embodiment except that plural rectifiers 4 are provided in parallel.

Plural inner pipes 3A to 3D are mounted on the small diameter part 20*b* of the device main body 2 with mounting members 5, and rectifiers 4A to 4D are disposed at the back ends of the inner pipes 3A to 3D, respectively.

The device main body 2 has an outlet port 22 having a diameter that is smaller than that in the first embodiment, whereby a turbulent flow is formed by making the inner fluid $L_1$ and the outer fluid $L_2$ flowing into the short diameter part 20*b* collide against a receiving surface 20*c* to facilitate mixing of the inner fluid $L_1$ and the outer fluid $L_2$.

In the fourth embodiment, the same inner fluid $L_1$ is introduced into the inner pipes 3A to 3D at a prescribed flow rate, and the outer fluid $L_2$ is introduced into the outer inlet port 21 at a prescribed flow rate, whereby the inner fluid $L_1$ forms a spiral flow with the rectifiers 4A to 4D and proceeds in the common flow channel $R_3$ to be in contact with the outer fluid $L_2$. The inner fluid $L_1$ and the outer fluid $L_2$ collide against the receiving surface 20*c* to form a turbulent flow, and the inner fluid $L_1$ and the outer fluid $L_2$ are mixed and discharged from the outlet port 22.

According to the fourth embodiment, two kinds of fluids can be mixed. Furthermore, a fluid obtained by mixing two kinds of fluids may repeatedly introduced into a microfluidic device having the same constitution as shown in FIG. 9 to mix three or more kinds of fluids. A plurality of the structures each having plural inner flow channels and plural outer flow channels connected in parallel may be disposed in series.

The invention is not limited to the aforementioned embodiments, and various modifications may be made therein unless the spirit and scope of the invention are deviated. The constitutional elements of the embodiments may be arbitrarily combined unless the spirit and scope of the invention are deviated. For example, in the constitutions shown in FIGS. 8 and 9, the rectifiers may be provided in the outer flow channels rather than the inner flow channels In the aforementioned embodiments, the donor substrate is produced by an electroforming method, but it may be produced by using a semiconductor process. For example, a donor substrate may be produced in the following manner. A substrate formed of a Si wafer is prepared, on which a releasing layer formed of polyimide is coated by a spin coating method. An Al thin film as a constitutional material of a microfluidic device is formed on the surface of the releasing layer, and the Al thin film is patterned by a photolithography method to produce a donor substrate.

Rectifiers may be provided in both the inner flow channel and the outer flow channel. In this case, the spiral directions may be the same as or different from each other. In the case where the spiral directions are different from each other, the difference in flow rate in the circumferential direction between the inner fluid and the outer fluid can be increased to accelerate a process, such as classification.

According to the fluid controlling method and the microfluidic device of the invention, the size of the device can be reduced, and classification with high accuracy can be carried out.

According to the process for fabricating a microfluidic device of the invention, production of a microfluidic device can be facilitated.

According to the fluid controlling method, various processes can be carried out by providing difference in flowing direction or in flowing rate of the fluids between the inner fluid and the outer fluid. The flow rates of the inner fluid and the outer fluid may be determined depending on the target process. The term "fluid" referred herein includes, for example, a liquid, a gas, and a liquid or gas containing particles.

It is possible in the fluid controlling method that the spiral flow of the inner fluid or the outer fluid is obtained by flowing the fluid through a rectifier that includes a plurality of rectifying plates continuously displaced in a circumferential direction at a prescribed angle. According to the constitution, the structure can be simplified because no source for driving force is required for flowing the fluid spirally.

It is possible in the fluid controlling method that a contact of the inner fluid and the outer fluid causes a prescribed process between the inner fluid and the outer fluid. The term "prescribed process" referred herein includes, for example, mixing, reaction, synthesis, dilution, cleansing and concentration.

It is possible in the fluid controlling method that a contact of the inner fluid and the outer fluid causes a transfer of particles contained in one of the inner fluid and outer fluid to the other fluid. According to the constitution, particles can be classified. It is also possible that compare to a flow rate of the fluid containing the particles, the other fluid has a higher flow rate. According to the constitution, transfer of the particles is accelerated.

According to the microfluidic device, in which a flow velocity in a circumferential direction is imparted to the inner fluid or the outer fluid, the inner fluid or the outer fluid having the flow velocity in the circumferential direction applied thereto flows spirally, and the inner fluid and the outer fluid are in contact with each other in the common flow channel. Various processes can be carried out by providing difference in flowing direction or flowing rate of the fluids between the inner fluid and the outer fluid flowing in the common flow channel.

It is possible in the microfluidic device that the rectifier includes a plurality of rectifying plates continuously displaced in a circumferential direction at a prescribed angle. According to the constitution, the fluid transfers along the surfaces of the rectifying plates, and thus is imparted with the flow velocity in the circumferential direction.

It is possible in the microfluidic device that the inner flow channel includes a plurality of inner flow channels disposed in series at a prescribed interval, that the outer flow channel includes a plurality of outer flow channels disposed in series at a prescribed interval, that the common flow channel includes a plurality of common channels each communicates with the plurality of inner flow channels and the plurality of outer flow channels, respectively and that the rectifier is provided in each of the plurality of inner flow channels or each of the plurality of outer flow channels. According to the constitution, the spiral flow can be prevented from being decreased in flow rate.

It is possible in the microfluidic device that the inner flow channel includes a plurality of inner flow channels disposed in parallel, that the outer flow channel includes a plurality of outer flow channels disposed in parallel, that the common flow channel is communicated with the plurality of inner flow channels and the plurality of outer flow channels and that the rectifier is provided in each of the plurality of inner flow channels or each of the plurality of outer flow channels. According to the constitution, for example, two or more kinds of fluids can be mixed.

According to the process for fabricating the microfluidic device, thin film patterns are laminated to construct a microfluidic device having a complex structure.

It is possible in the process that the step of forming is carried out by an electroforming method. In the case where an electroforming method is used, a metallic substrate or a non-metallic substrate having a metallic film provided thereon can be used as the first substrate.

It is possible in the process that the step of forming is carried out by a semiconductor process. In the case where a semiconductor process is used, a Si wafer, a glass substrate or a quartz substrate, for example, can be used as the first substrate.

It is preferred in the process that in the step of repeating, bonding of the first substrate and the second substrate is carried out by surface-activated bonding at room temperature. By bonding the substrates at room temperature, thin films to be bonded suffer less change in shape and thickness to obtain a mechanical device having high accuracy. It is also preferred that the surface of the thin film is cleaned by irradiating with a neutral atomic beam, an ion beam or the like. By cleaning the surface, the surface can be further activated to obtain firm bonding.

The entire disclosure of Japanese Patent Application No. 2005-166456 filed on Jun. 7, 2005 including specification, claims, drawings and abstract is incorporated herein by reference in its entirety.

What is claim is:

1. A fluid controlling method for classifying particles by a microfluidic device that includes: an inner flow channel in which an inner fluid flows; an outer flow channel in which an outer fluid flows, the outer flow channel being formed coaxially with the inner flow; a common flow channel in which the inner fluid and the outer fluid flow are in contact with each other, the common flow channel being communicated with, and downstream of, the inner flow channel and the outer flow channel: and a rectifier that adds a flow velocity in a circumferential direction to one of the inner fluid and the outer fluid, the rectifier being positioned between one of the inner flow channel and the outer flow channel and the common flow channel, the rectifier being disposed in one of the inner flow channel and the outer flow channel, and the inner fluid and the outer fluid flowing as laminar flows;

the method comprising:

sending the inner fluid from the inner flow channel to the common flow channel; and sending the outer fluid coaxially with the inner fluid from the outer flow channel to the common flow channel through the rectifier such that in the common flow channel the outer fluid flows outward of, and coaxially with, the inner fluid;

wherein one of the inner fluid and the outer fluid includes a corkscrew flow that flows spirally; and the inner fluid and the outer fluid are in contact with each other, and the inner fluid and the outer fluid are in initial contact with each other at or downstream of the downstream end of the rectifier, and the inner fluid and outer fluid flow as laminar flows, wherein all the inner fluid and outer fluid exits the microfluidic device at the common flow channel exit.

2. The fluid controlling method according to claim 1, wherein the corkscrew flow is obtained by flowing the inner fluid or the outer fluid through a rectifier; and wherein the rectifier includes a plurality of rectifying plates continuously displaced in a circumferential direction at a prescribed angle.

3. The fluid controlling method according to claim 1, wherein a contact of the inner fluid and the outer fluid causes at least one of a reaction, a synthesis, a dilution, a cleansing or a concentration between the inner fluid and the outer fluid.

4. The fluid controlling method according to claim 1, wherein a flow of the inner fluid proceeds at least one of in a different direction or at a different rate than a flow of the outer the fluid.

5. The fluid controlling method according to claim 2, wherein the rectifier is stationary and the prescribed angle is with respect to a respective fluid flow channel.

6. A microfluidic device comprising:

an inner flow channel in which an inner fluid flows;

an outer flow channel in which an outer fluid flows, the outer flow channel being formed coaxially with the inner flow;

a common flow channel in which the inner fluid and the outer fluid flow are in contact with each other such that the outer fluid flows outward of, and coaxially with, the inner fluid, the common flow channel being communicated with, and downstream of, the inner flow channel and the outer flow channel; and a rectifier that adds a flow velocity in a circumferential direction to one of the inner fluid and the outer fluid, the rectifier being positioned between one of the inner flow channel and the outer flow channel and the common flow channel, wherein the rectifier is disposed in one of the inner flow channel and the outer flow channel, and the inner fluid and the outer fluid flow as laminar flows, such that the inner and outer fluid are in initial contact at or downstream of the downstream end of the rectifier, wherein all the inner fluid and outer fluid exits the microfluidic device at the common flow channel exit.

7. The microfluidic device according to claim 6, wherein the rectifier includes a plurality of rectifying plates continuously displaced in a circumferential direction at a prescribed angle.

8. The microfluidic device according to claim 6, wherein the inner flow channel includes a plurality of inner flow channels disposed in series at a prescribed interval;

wherein the outer flow channel includes a plurality of outer flow channels disposed in series at a prescribed interval;

wherein the common flow channel includes a plurality of common channels each communicated with the plurality of inner flow channels and the plurality of outer flow channels, respectively; and wherein the rectifier is provided in each of the plurality of inner flow channels or each of the plurality of outer flow channels.

9. The microfluidic device according to claim 6, wherein the inner flow channel includes a plurality of inner flow channels disposed in parallel;

wherein the outer flow channel includes a plurality of outer flow channels disposed in parallel;

wherein the common flow channel is communicated with the plurality of inner flow channels and the plurality of outer flow channels; and wherein the rectifier is provided in each of the plurality of inner flow channels or each of the plurality of outer flow channels.

10. The microfluidic device according to claim 6, wherein the common flow channel is downstream of, and shares a common axis with, the inner flow channel and the outer flow.

11. The microfluidic device according to claim 6, wherein the rectifier is stationary.

12. The microfluidic device according to claim 7, wherein the rectifier is stationary and the prescribed angle is with respect to the one of the inner flow channel and the outer flow channel within which the stationary rectifier is disposed.

* * * * *